US011295921B2

(12) United States Patent
Lynch

(10) Patent No.: US 11,295,921 B2
(45) Date of Patent: Apr. 5, 2022

(54) FUSE CUTOUT COVER WITH SPACER FOR LOADBREAK TOOL

(71) Applicant: Eco Electrical Systems, Reno, NV (US)

(72) Inventor: Michael Lynch, Reno, NV (US)

(73) Assignee: Eco Electrical Systems, Reno, NV (US)

( * ) Notice: Subject to any disclaimer, the term of this patent is extended or adjusted under 35 U.S.C. 154(b) by 284 days.

(21) Appl. No.: 16/442,248

(22) Filed: Jun. 14, 2019

(65) Prior Publication Data

US 2020/0395184 A1 Dec. 17, 2020

(51) Int. Cl.
*H01H 85/25* (2006.01)
*H01H 31/00* (2006.01)

(52) U.S. Cl.
CPC ..... *H01H 85/25* (2013.01); *H01H 31/006* (2013.01)

(58) Field of Classification Search
CPC .... H01H 85/25; H01H 31/006; H01H 31/125; H01H 9/0264
USPC ..... 174/138 F, 138
See application file for complete search history.

(56) References Cited

U.S. PATENT DOCUMENTS 3,079,457 A * 2/1963 Newcomb, Jr. ..... H01H 31/127 174/5 R
9,916,956 B1 * 3/2018 Rauckman ..... H01H 85/25

* cited by examiner

*Primary Examiner* — Scott Bauer
*Assistant Examiner* — Sreeya Sreevatsa
(74) *Attorney, Agent, or Firm* — Patent Law Group; Brian D Ogonowsky

(57) ABSTRACT

A fuse cutout cover is disclosed that allows a lineman to engage a metal hook assembly and pull ring of the cutout with a loadbreak tool. The cutout also includes a wire connector and a metal top connector that leads from the wire connector to the top of the fuse. A front opening in the cover allows easy access by a loadbreak tool over a wide range of angles. A roof of the cover extends beyond the sidewalls of the opening and covers an end of the top connector. An inner vertical wall of the cover has a bottom edge that rests on the top surface of the top connector to space the roof from the top connector to provide additional vertical clearance when positioning the loadbreak tool to engage the cutout. The wall also blocks access to the enlarged open to prevent birds from nesting in the opening.

16 Claims, 7 Drawing Sheets

ECO-P-116

5 / 7

ECO-P-116

6 / 7

FUSE CUTOUT COVER WITH SPACER FOR LOADBREAK TOOL

FIELD OF THE INVENTION

The invention relates to a dielectric cover for a high voltage fuse cutout that protects birds and other animals from electrocution, which may also trigger an over-current condition that causes a power outage. The invention more particularly relates to a cover that makes it easier for a lineman to engage a conventional loadbreak tool with the cutout for opening the cutout.

BACKGROUND

FIGS. 1-3 are presented to illustrate a problem with one type of cutout cover, but all cutout covers known to the inventor have similar problems. The cutout cover of FIG. 3 is the inventor's own prior design.

FIG. 1 illustrates a conventional fuse cutout 10. A mounting bracket 12 secures a ceramic or polymer insulator 14 to a wooden utility pole or cross-arm used to support high voltage conductors, such as carrying 3-phase 12 KVAC or higher. A "hot" wire 16 is attached to one phase. A metal wire connector 18 electrically connects the wire 16 to a metal top connector 20 (the "first connector") whose end electrically contacts the top of a blowable fuse 22. The fuse 22 electrically connects to a pivot joint 24 and a bottom connector 26. The bottom connector 26 is connected to another wire (not shown) which may lead to a transformer or any other electrical device or conductor. Opening or blowing of the fuse 22 disconnects the top connector 20 from the bottom connector 26.

A metal hook assembly 28 is fixed to the top connector 20 and is used to temporarily support a loadbreak tool for opening the fuse 22 (described with respect to FIG. 2). The bent hook assembly 28 is better shown in later figures. A metal pull ring 30 is physically and electrically connected to the upper end of the fuse 22 for pulling down the fuse 22 and pushing it back in place.

FIG. 2 is a simplified illustration of a portion of a conventional loadbreak tool 34, such as the Loadbuster™ by S&C Electric Company, that is used by linemen to open the fuse 22 while the wire 16 is energized. A description of the well-known Loadbuster™ is found at the web address http://www.sandc.com/en/products--services/products/load-buster-tool/ and is incorporated herein by reference. A long dielectric pole 35 is affixed to the bottom portion of the loadbreak tool 34 for manipulating the loadbreak tool 34 by the lineman. The diagram of the loadbreak tool 34 is intended to illustrate any loadbreak tool or hotstick used by a lineman that allows the lineman to open and close the fuse 22 while the wire 16 is energized. The loadbreak tool 34 is formed of a dielectric material with two metal hooks that engage the cutout 10, as described below, to allow the lineman to open and close the fuse 22 at a distance to avoid arcing.

The loadbreak tool 34 is positioned by a lineman, while the wire 16 is energized, so that an opening in a metal upper hook 36 of the loadbreak tool 34 is physically and electrically engaged with the metal hook assembly 28 of the cutout 10. Another metal hook 37 at the end of the pole 35 is physically and electrically engaged with the metal pull ring 30, electrically connected to the top of the fuse 22. The metal hook 37 is electrically connected to a loadbreak mechanism internal to the loadbreak tool 34. When the lineman pulls down on the pole 35, the slidable portion 38 is also pulled down. When the pole 35 and slidable portion 38 are pulled down by the lineman, the fuse 22 is pulled away from the top connector 20, and the loadbreak tool 34 creates a parallel circuit (internal to the loadbreak tool 34) that prevents arcing while the fuse 22 is being pulled down. Once the fuse 22 is pulled down a certain distance, a spring in the loadbreak tool 34 rapidly separates contacts within the loadbreak tool 34 to prevent arcing. The loadbreak tool 34 is then removed, and there is an open circuit between the wire 16 and the bottom connector 26.

In a simpler version, the loadbreak tool is simply a stick with a hook that engages the pull ring 30 to allow the linemen to open the fuse 22 when the wire 16 is energized.

FIG. 3 illustrates a representative cutout cover 50, designed by the Applicant, used to show a problem that exists with most or all cutout covers. The cover 50 is partially transparent to show the cutout 10. The cover 50 is not prior art.

The cover 50 is a one-piece molded polymer.

A first portion 52 of the cover 50 includes a vertical slot 54 through which the energized wire 16 is inserted when installing the cover 50 over the cutout 10. The first portion 52 also covers the top of the insulator 14 (above the top skirt) to prevent wildlife from contacting the wire connector 18.

A second portion 58 of the cover 50 includes a flat roof 60, which covers the energized top connector 20 and portions of the hook assembly 28 and pull ring 30. The roof 60 is slightly wider than the top connector 20, hook assembly 28, and pull ring 30 to prevent birds alighting on the energized top connector 20, hook assembly 28, and pull ring 30.

The sidewalls 62 of the second portion 58 flare out and terminate before the end of the cover 50 in order to allow the loadbreak tool 34 (FIG. 2) to enter from the side. The roof 60 is flat (rather than arched) so as not to restrict lateral movement of the loadbreak tool. No sidewall is laterally located next to the hook assembly 28 and pull ring 30 to allow maximum access by the loadbreak tool. The sidewalls 62 extend down to approximately the level of the hook assembly 28.

The cover 50 has a middle expanded portion 64 to accommodate the wire connector 18 and the top portion of the insulator 14.

The cover 50 has through-holes 66, 67, and 68. In an example of one type of insulator 14, identical securing pins (not shown) are inserted, using a hotstick, through the holes 66 and 68 and under the top connector 20 to keep the cover 50 in place in high winds. For a wider insulator 14, the pins would be inserted through the through-holes 67 and 68. The pin through hole 67 goes under the wire connector 18. A suitable pin is described in Applicant's U.S. Pat. No. 8,963,011, incorporated herein by reference. The holes 66, 67, and 68 may also be grabbed by a hot stick to position the cover 50.

Once the cover 50 is installed, a bird on the cross-arm of the utility pole cannot contact the energized metal of the cutout 10 since the opening in the cover 50 is facing away from the cross-arm. Since there is very little open space in the cover 50, wildlife cannot nest in the opening and squirrels cannot store nuts in the opening.

Although the loadbreak tool 34 (FIG. 2) can access the hook assembly 28 and pull-ring 30 over a wide range of angles, the top of the loadbreak tool 34 tends to come in contact with the under-surface of the roof 60 of the cover 50 when the lineman is trying to position the loadbreak tool 34. This contact with the roof 60 makes it more difficult to position the loadbreak tool 34. Since the lineman controls the loadbreak tool 34 using a long pole 35, it is relatively difficult to rapidly engage the hook assembly 28 and pull-ring 30.

Therefore, what is needed is a minimal modification to the existing cover 50 and similar covers that gives the lineman more vertical space to position the loadbreak tool with respect to the cutout while not creating any inviting space within the cover for a bird to build a nest. The modification should not decrease the insulating properties of the cover in any way.

SUMMARY

A spacer is molded into a cutout cover that causes the roof of the cover over the cutout's hook assembly to be spaced further above the hook assembly. This gives the lineman more vertical space above the cutout to engage the loadbreak tool with the hook assembly and pull ring of the cutout.

The spacer is a vertical wall within the cover whose bottom edge rests on the energized top connector of the cutout. Without the wall, the roof of the cover would rest directly on the top connector. The wall also blocks birds and other animals from entering the enlarged opening around the hook assembly, so there is synergy.

The wall also creates an additional air gap between the energized top connector and the outer surface of the cover, so the insulating properties of the cover are improved, creating further synergy.

The cover to be improved by the wall spacer may be that previously described or any other existing cover.

BRIEF DESCRIPTION OF THE DRAWINGS

Elements in the various figures that are the same or equivalent are labelled with the same numeral.

DETAILED DESCRIPTION

FIGS. 4-8 illustrate one embodiment of the invention, and the inventive feature can be applied to any type of cutout cover.

Figure 3:
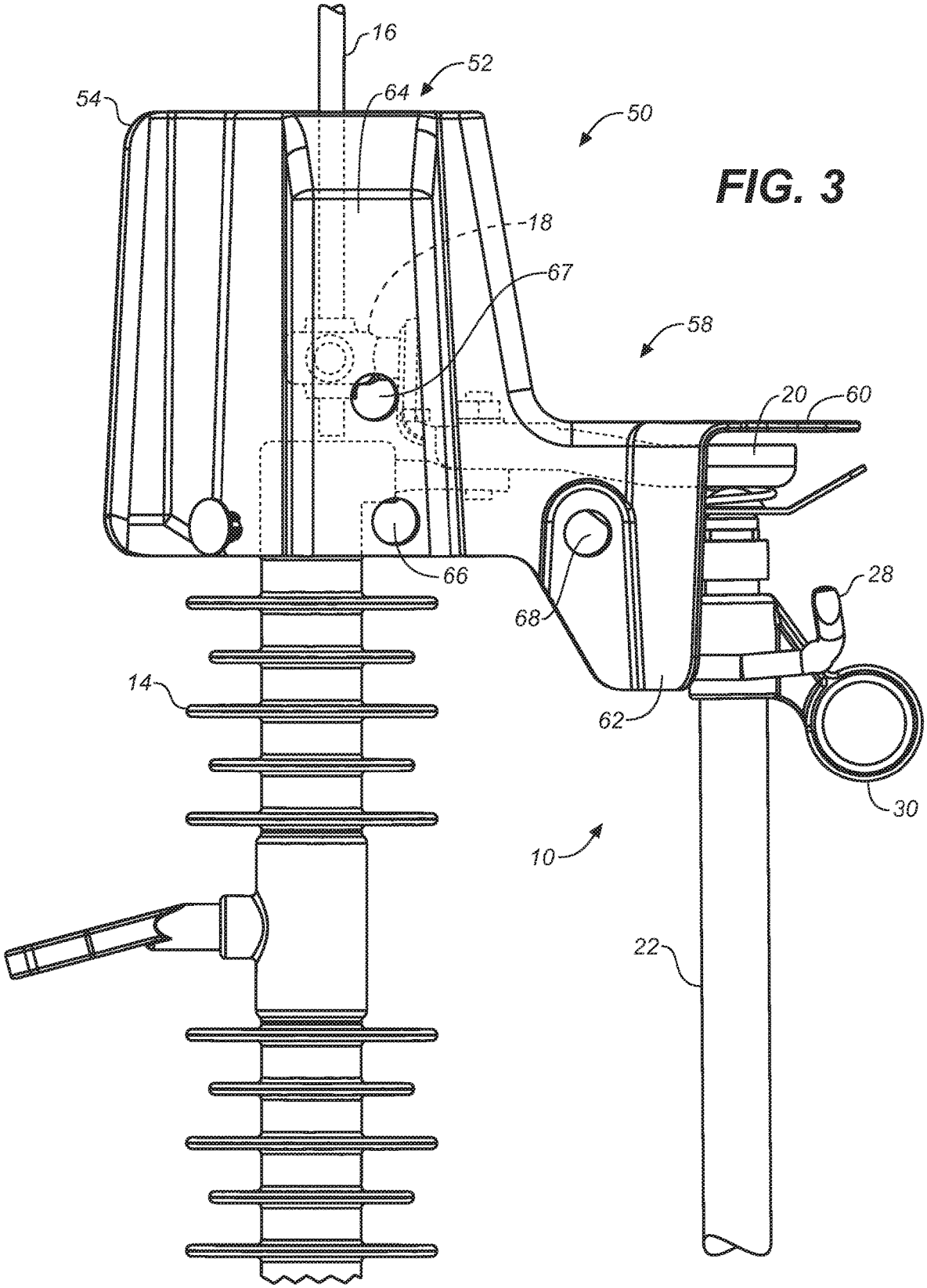
FIG. 3 is a partially transparent side view of a cover, without the inventive feature, installed over the cutout of FIG. 1, where the roof of the cover rests on the energized top connector of the cutout, which restricts the vertical access to the hook assembly and pull-ring of the cutout as the lineman is trying to engage the loadbreak tool with the cutout.
Figure 4:
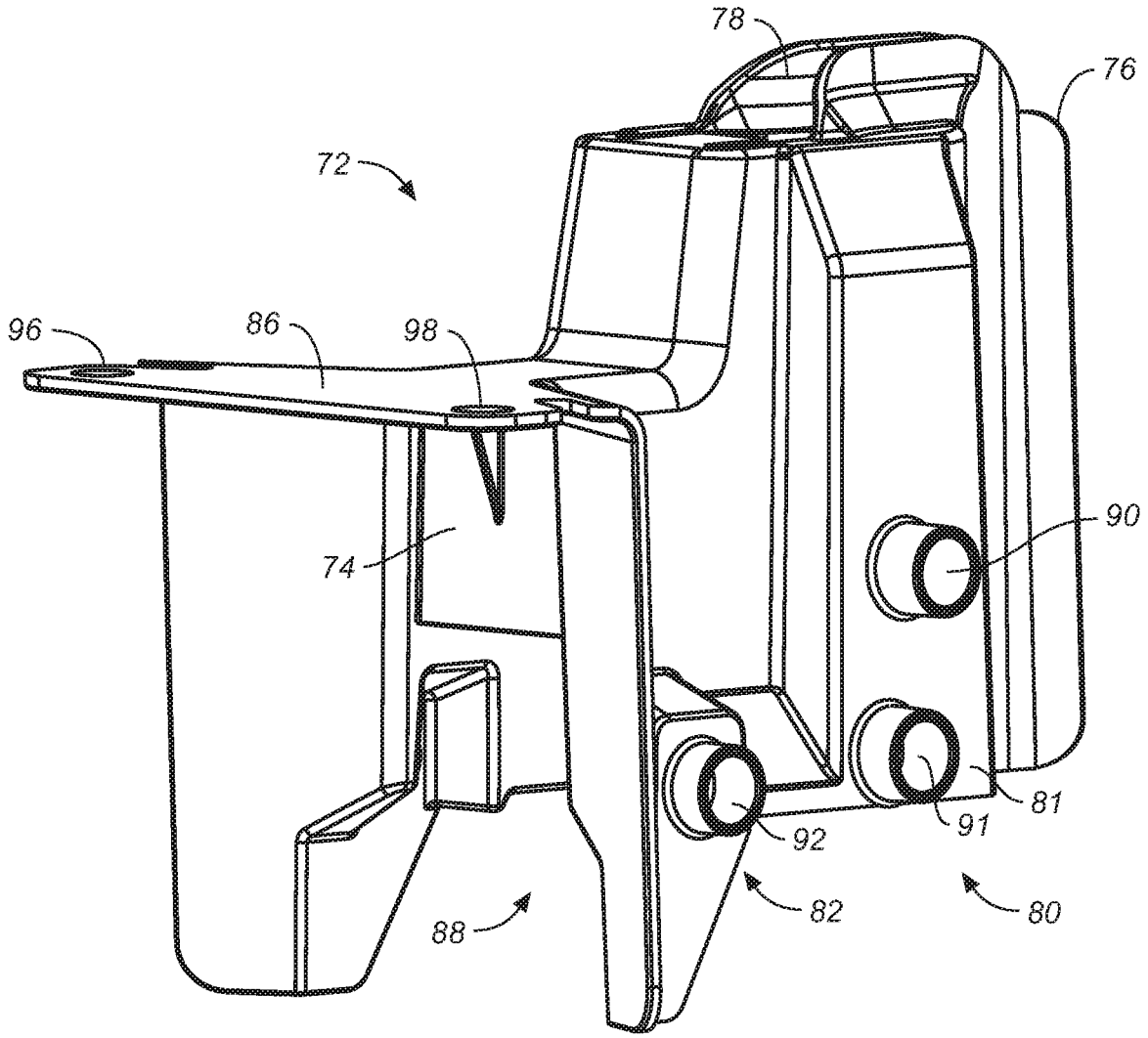
FIG. 4 is a perspective view of the new cutout cover design, in accordance with one embodiment of the invention, showing the inner vertical wall near the opening of the cover.
Figure 5:
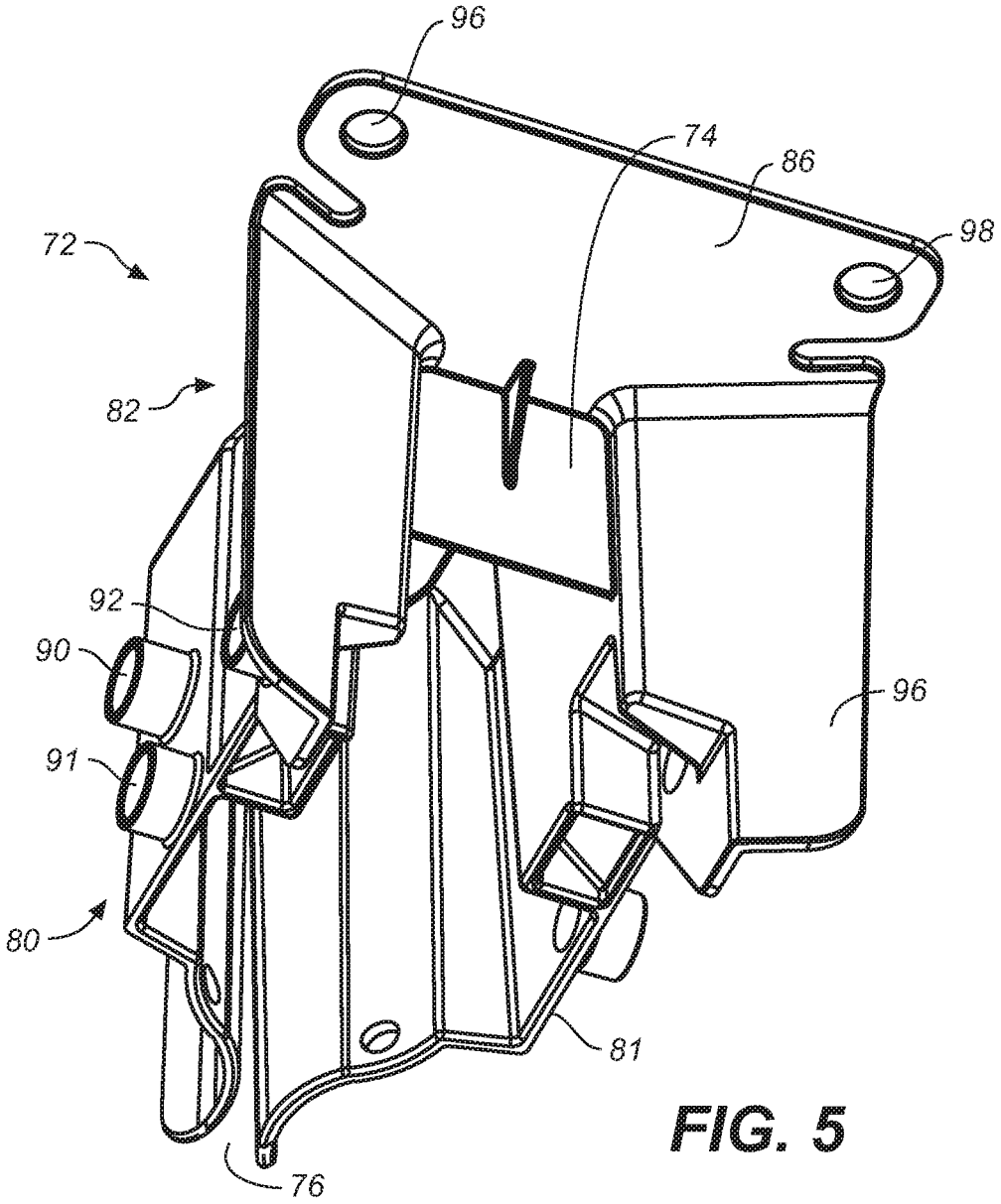
FIG. 5 is a bottom-up perspective view of the cover of FIG. 4.

The cutout cover 72 of FIGS. 4-8 is similar to that shown in FIG. 3 except for the addition of an inner vertical wall 74 (the "wall") molded in the cover 72, and the cover 72 being taller to accommodate the wall 74.

The cover 72 has a rear vertical slot 76 for receiving an energized wire 16 (FIG. 6) connected to the cutout 10. The wire 16 extends through a top opening 78 after installation.

Figure 1:
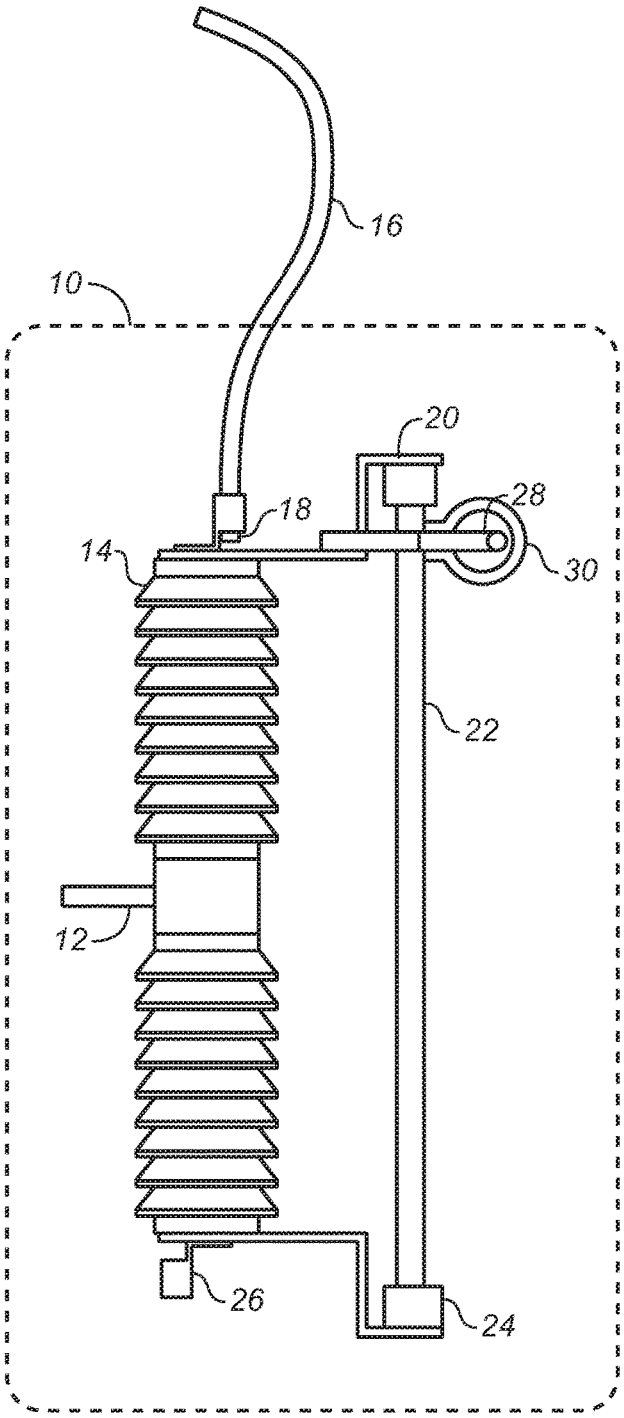
FIG. 1 (PRIOR ART)
FIG. 1 is a side view of a conventional fuse cutout.
Figure 2:
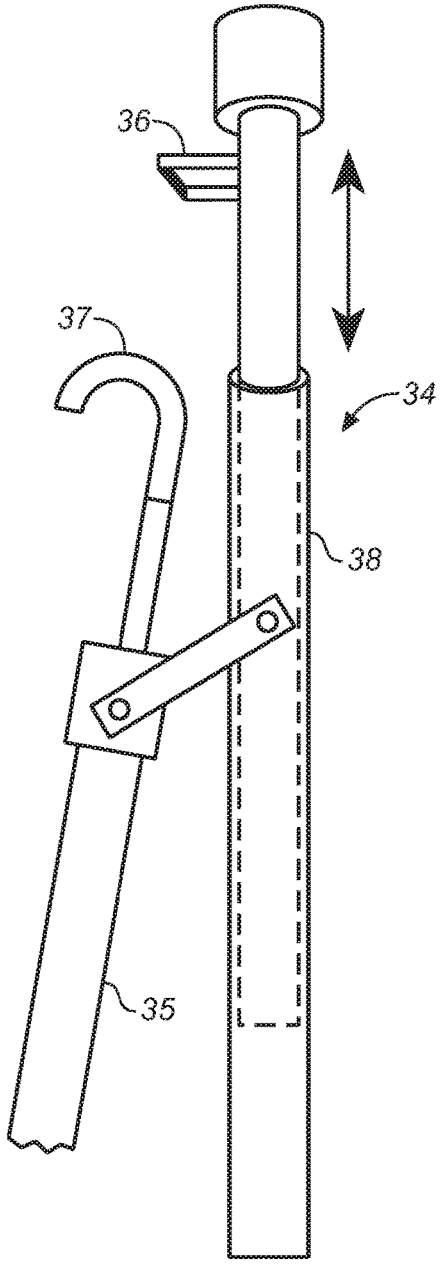
FIG. 2 (PRIOR ART)
FIG. 2 illustrates a conventional loadbreak tool for operating a conventional cutout.
Figure 7:
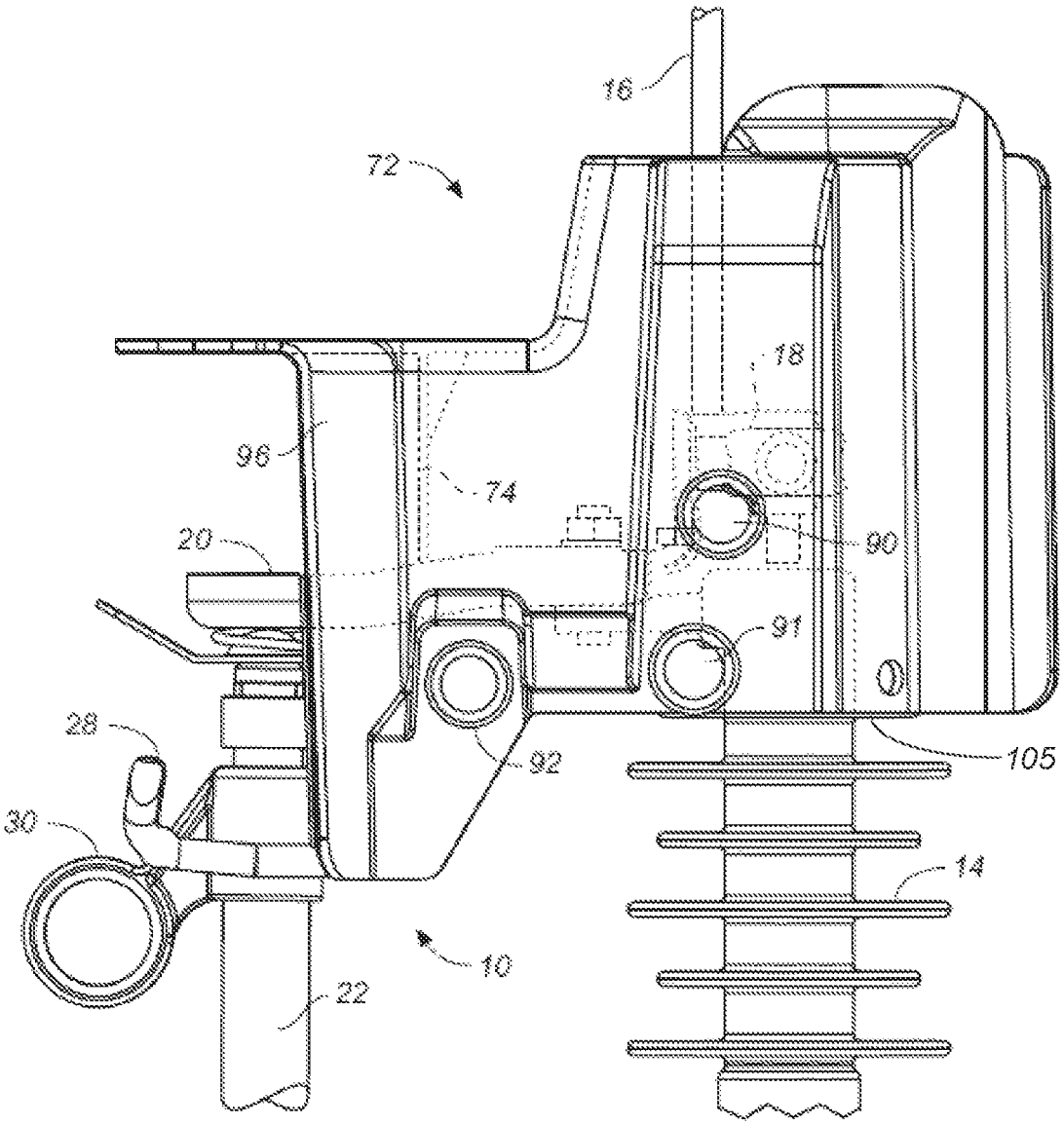
FIG. 7 is a partially transparent side view of the cover over a cutout showing the vertical wall resting on the top connector of the cutout.
Figure 8:
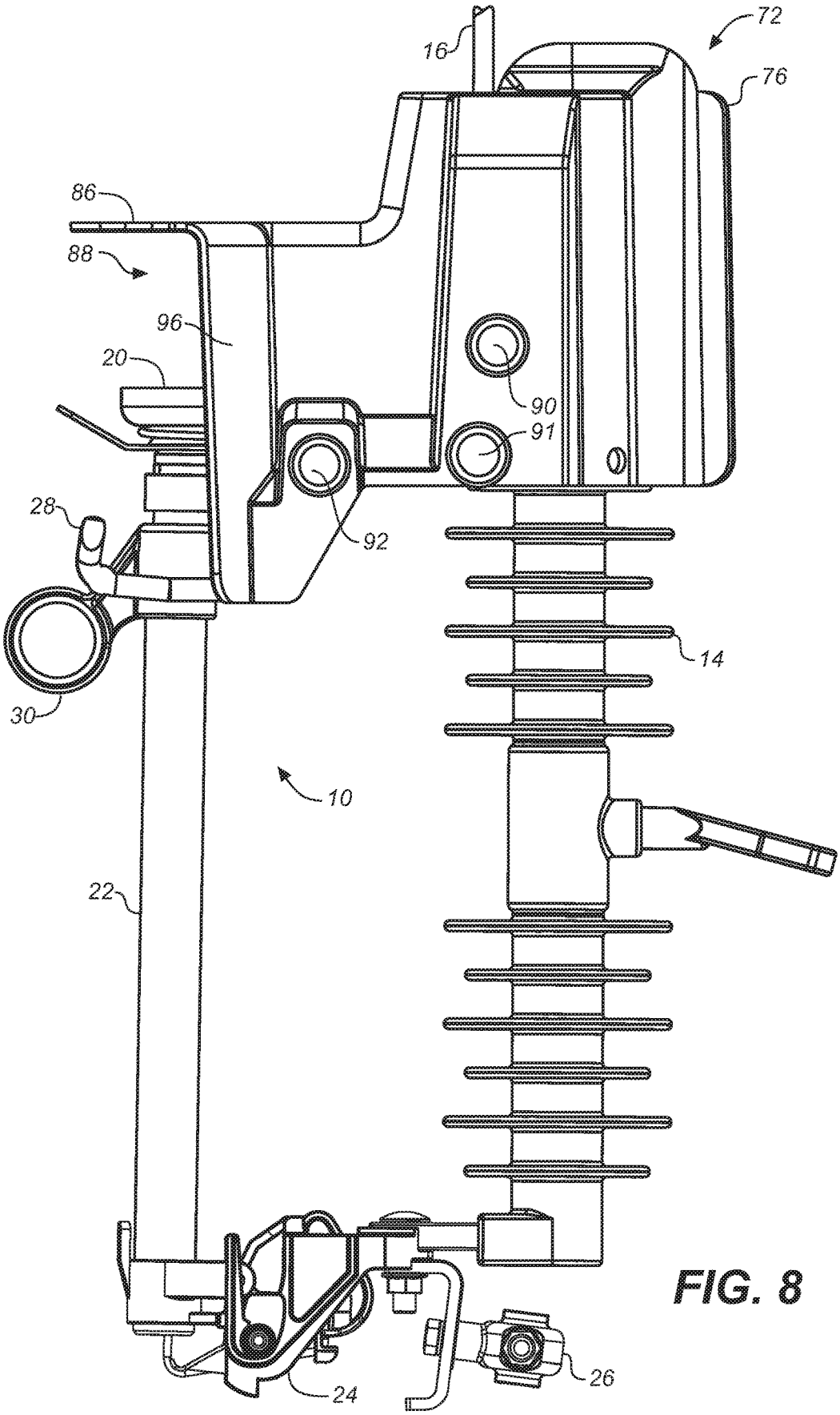
FIG. 8 is a side view of the cover of FIGS. 4-7 over a cutout, showing how the roof of the cover is well above the top connector of the cutout to increase the vertical access to the hook assembly and pull-ring of the cutout as the lineman is trying to engage the loadbreak tool with the cutout.

The back portion 80 (the "first portion") of the cover 72 covers the insulator 14 and the cutout's wire connector 18 (FIG. 7). The middle of the back portion 80 has a widened section 81 to accommodate the top of the insulator 14. The front portion 82 (the "second portion") covers the cutout's top connector 20 between the wire connector 18 (the "connector for the wire") and the fuse 22 and also covers a portion of the hook assembly 28. The front portion 82 includes a roof 86 and a flared out opening 88 to allow the loadbreak tool 34 (FIG. 2) to access the hook assembly 28 and pull-ring 30 through a wide range of angles. The roof 86 may be flat or arched.

Through-holes 90, 91, and 92 receive pins 94 (FIG. 6) that extend under the top connector 20 and wire connector 18 of the cutout 10 to keep the cover 72 in place in high winds.

The holes 96 and 98 in the roof 86 can be grabbed with a hot stick to position the cover 72 over the cutout 10.

Figure 6:
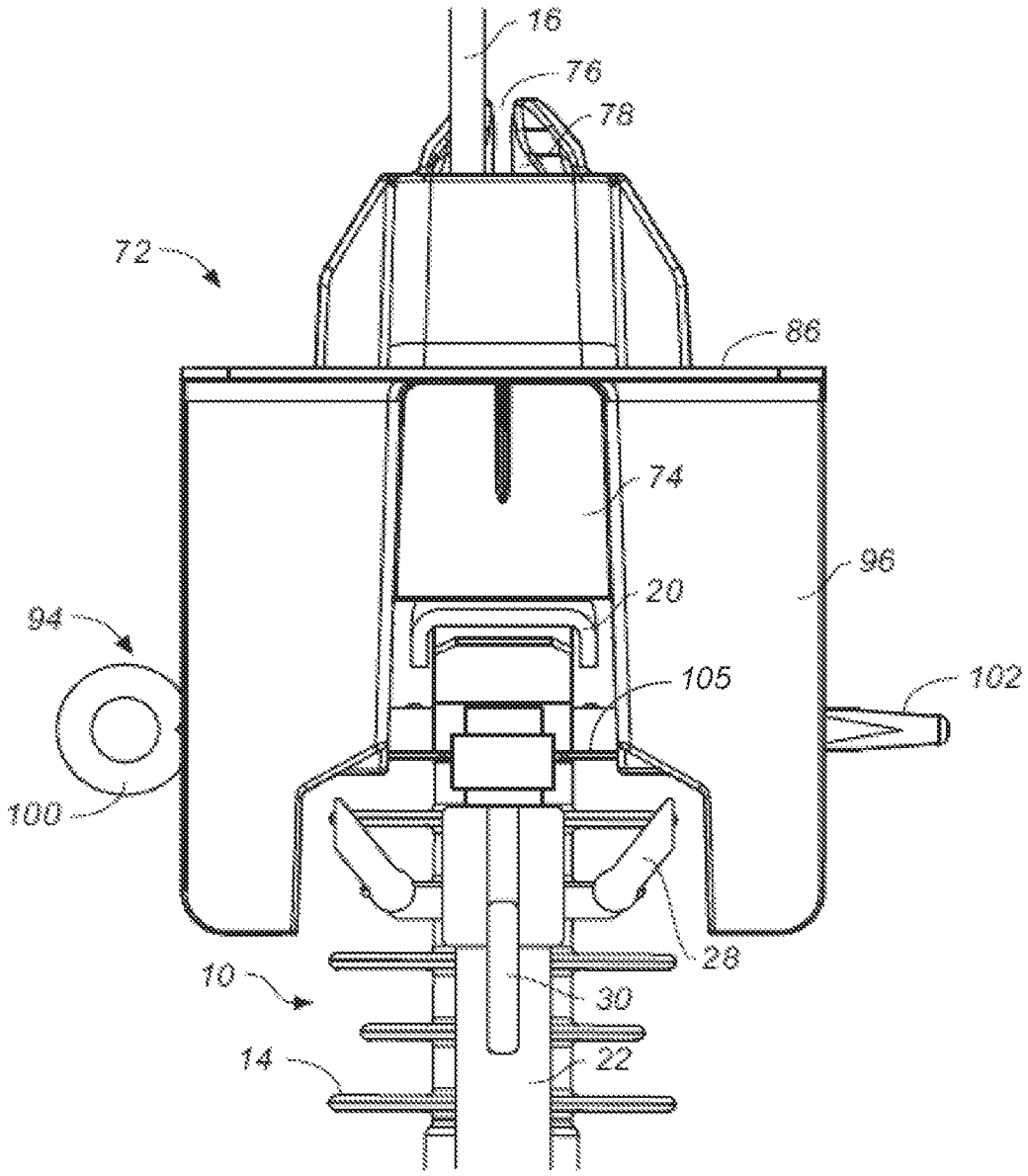
FIG. 6 is a front view of the cover of FIGS. 4 and 5 secured over a cutout with a pin, where the bottom edge of the vertical wall rests on the top connector of the cutout to space the roof from the top connector.

FIG. 6 is a front view of the installed cover 72 showing how the bottom edge of the vertical wall 74 rests on the top connector 20 to space the roof 86 from the top connector 20. The partially transparent side view of FIG. 7 also shows the bottom edge of the vertical wall 74 resting on the top connector 20.

The cover 72 has to be taller than the cover 50 in FIG. 3, due to the added vertical spacing by the wall 74, to enable the pins 94 (FIG. 6) to extend through the through holes 90-92 under the top connector 20 and the wire connector 18.

As seen, the vertical wall 74 shifts the roof 86 upward a few inches, such as at least 2 inches, to give the lineman more vertical clearance when positioning the loadbreak tool 34 (FIG. 2) for engaging the hook assembly 28 and pull-ring 30. The preferred height of the wall 74 is approximately 1-3 inches. The top of the loadbreak tool 34 can now easily fit under the roof 86 while the hooks 36 and 37 of the loadbreak tool 34 engage the hook assembly 28 and pull-ring 30 of the cutout 10.

The vertical wall 74 also blocks access to the enlarged space over the top connector 20 so that birds cannot build a nest in the enlarged space, or squirrels cannot store nuts in the enlarged space. The wall 74 should be located slightly in back of the sidewalls 96 flaring out near the opening 88.

Further, due to the wall 74 adding an air gap between the roof 86 and the energized top connector 20, the insulation properties of the cover 72 are increased. Therefore, there is synergy by adding the vertical wall 74.

The pin 94 (FIG. 6) has a ring 100 that engages a hook on a hotstick. At the other end of the pin 94 is a resilient portion 102 with a narrow tip that expands outward at about a 15 degree angle. The resilient portion 102 allows the pin 94 to be inserted easily through the holes by the hotstick, but the top of the resilient portion 102 has a 45 degree angle, which makes it much more difficult to remove the pin 94. The pins 94 extend below the wire connector 18 and the top connector 20 so the cover 72 does not blow off in high winds. More detail regarding the pin 94 is found in the inventor's U.S. Pat. No. 8,963,011, incorporated herein by reference. The pin 94 need not go through both through-holes, but added security is achieved by going through both holes.

In a preferred embodiment, the cover 72 is made only slightly wider than the cutout 10 so as to not take up excess space. This allows the cutout 10 and cover 72 to be sold in the same box that is typically used just for cutouts 10. The cover 72 is narrower than the top skirt of the insulator 14 so as to not surround the top skirt. This allows the back of the cover 72 to be supported by the top skirt 105 (FIGS. 6 and 7) of the insulator 14 and the front of the cover 72 to be supported by the bottom edge of the wall 74 resting on the top connector 20. The cover 72 is designed to be approximately horizontal in this configuration if the cutout is vertical.

As seen in FIG. 7, the roof 86 overlies a portion of the hook assembly 28 and there are no sidewalls extending down from the roof 86 next to the hook assembly 28 and the pull ring 30. Since the hook assembly 28 and pull ring 30 are laterally exposed, and the roof 86 is well above the top connector 20, the lineman can more easily position the loadbreak tool into the opening to engage the hook assembly 28 and pull ring 30 to open the cutout 10. The cover 72 allows a lineman to engage the hook assembly 28 and pull ring 30 with the loadbreak tool while the loadbreak tool has an angle at least 45 degrees relative to vertical, and the spaced roof 86 gives the loadbreak tool an additional 1-3 inches of vertical clearance.

The areas with the through-holes are stepped out from the remainder of the cover 72 to compensate for the reduced insulating properties as a result of the hole. Modeling of the design shows that the stepped out distance offsets the effect of the hole so the insulating properties of the cover are fairly consistent over the cover 72.

Having described the invention in detail, those skilled in the art will appreciate that, given the present disclosure, modifications may be made to the invention without departing from the spirit of the inventive concept described herein. Therefore, it is not intended that the scope of the invention be limited to the specific embodiments illustrated and described.

What is claimed is:

1. A fuse cutout dielectric cover, the fuse cutout comprising an insulator, a first connector that provides an electrical connection between an energized wire and a top end of a fuse, where the first connector conducts a current when providing the electrical connection between the energized wire and the top end of the fuse, a metal hook assembly electrically contacting the first connector, and a metal pull ring fixed to the fuse, wherein the metal hook assembly and the metal pull ring are configured to be simultaneously engaged by a loadbreak tool for physically and electrically disengaging a portion of the fuse from the metal hook assembly when the loadbreak tool is pulled generally downward by a lineman, the fuse cutout dielectric cover comprising:

a first portion configured for at least covering a top of the insulator;

a second portion extending from the first portion, the second portion having a roof portion configured for covering at least a portion of the first connector; and a wall inside the fuse cutout dielectric cover within the second portion, the wall having a bottom edge that is configured to contact a top surface of the first connector to support the fuse cutout dielectric cover over the cutout and space the roof portion away from a top of the first connector.

2. The fuse cutout dielectric cover of claim 1 wherein the second portion has sidewalls that are separated by a first width and then flare out at an end of the second portion, and wherein the wall is located in the second portion where the sidewalls are separated by the first width.

3. The fuse cutout dielectric cover of claim 1 wherein the wall has a height of 1-3 inches so as to space the roof portion from the top surface of the first connector by 1-3 inches.

4. The fuse cutout dielectric cover of claim 1 wherein the fuse cutout dielectric cover is a molded polymer and the wall is a molded portion of the fuse cutout dielectric cover.

5. The fuse cutout dielectric cover of claim 1 wherein the roof portion covers at least a portion of the metal hook assembly.

6. The fuse cutout dielectric cover of claim 1 wherein the fuse cutout dielectric cover is configured such that the metal hook assembly and the metal pull ring are laterally exposed, when the fuse cutout dielectric cover is installed over the cutout, to allow the loadbreak tool to engage the metal hook assembly and the metal pull ring at a wide range of angles.

7. The fuse cutout dielectric cover of claim 1 further comprising sidewalls extending from the second portion, wherein the sidewalls terminate so as to laterally expose the metal hook assembly and the metal pull ring.

8. The fuse cutout dielectric cover of claim 1 wherein the roof portion is configured to overlie at least portions of the metal hook assembly and the metal pull ring, and wherein there are no sidewalls extending down from the roof portion that overlies the metal hook assembly and the metal pull ring.

9. The fuse cutout dielectric cover of claim 1 further comprising pins configured for being inserted through holes in the cover for preventing the fuse cutout dielectric cover from being blown off the cutout.

10. The fuse cutout dielectric cover of claim 1 wherein the roof portion is substantially flat.

11. The fuse cutout dielectric cover of claim 1 wherein the roof portion is arched.

12. The fuse cutout dielectric cover of claim 1 wherein the fuse cutout dielectric cover is a one-piece molded unit.

13. The fuse cutout dielectric cover of claim 1 wherein the fuse cutout dielectric cover is installed over the fuse cutout.

14. The fuse cutout dielectric cover of claim 1 wherein the insulator has a top skirt, and wherein the fuse cutout dielectric cover is narrower than the top skirt so as to not surround the top skirt.

15. The fuse cutout dielectric cover of claim 1 wherein the fuse cutout dielectric cover is installed over the cutout, the fuse cutout dielectric cover further comprising one or more pins that extend through holes in the fuse cutout dielectric cover and below the top connector to secure the fuse cutout dielectric cover in position.

16. The fuse cutout dielectric cover of claim 15 wherein at least one of the pins extends below a connector for the wire.

* * * * *